United States Patent [19]

Cooper

[11] Patent Number: 5,074,444

[45] Date of Patent: Dec. 24, 1991

[54] METHOD AND APPARATUS FOR FOLDING A LONG SLEEVE SHIRT

[75] Inventor: Keith D. Cooper, Jasper County, Ga.

[73] Assignee: All-Pak Machinery Systems, Inc., Decatur, Ga.

[21] Appl. No.: 453,612

[22] Filed: Dec. 20, 1989

[51] Int. Cl.[5] ..... A41H 33/00

[52] U.S. Cl. ..... 223/37; 223/38

[58] Field of Search ..... 223/37, 38

[56] References Cited

U.S. PATENT DOCUMENTS

| | | | |
|---|---|---|---|
| 1,873,954 | 8/1932 | Cooper | 223/37 |
| 2,629,520 | 2/1953 | Johnson | 223/37 |
| 2,665,039 | 1/1954 | Neckel | 223/37 |
| 3,013,704 | 12/1961 | Freeman | 223/37 |
| 3,055,563 | 9/1962 | Pilola | 223/37 |
| 3,269,619 | 8/1966 | Freeman | 223/37 |
| 3,477,619 | 11/1969 | Lee | 223/37 |
| 4,222,507 | 9/1980 | Bengtsson | 223/37 |
| 4,512,464 | 4/1985 | Sylvester | 206/292 |

FOREIGN PATENT DOCUMENTS

| | | | |
|---|---|---|---|
| 2308135 | 8/1974 | Fed. Rep. of Germany | 223/37 |
| 3733816 | 10/1989 | Fed. Rep. of Germany | 223/37 |
| 3143100 | 6/1988 | Japan | 223/37 |
| 2024142 | 1/1980 | United Kingdom | 223/37 |
| 8803580 | 5/1988 | World Int. Prop. O. | 223/37 |
| 8901070 | 2/1989 | World Int. Prop. O. | 223/37 |

OTHER PUBLICATIONS

Amscomatic K-700 Automatic Folding Machine—All-Pak Machinery Systems, Inc.—6 page Fold Brochure.

*Primary Examiner*—Werner H. Schroeder
*Assistant Examiner*—Bibhu Mohanty
*Attorney, Agent, or Firm*—Louis T. Isaf

[57] ABSTRACT

A method of folding a long-sleeve garment which includes a method of pre-folding the sleeves which pre-folding method lends itself to automated techniques; and, further, an apparatus for performing the invented method, including the pre-folding method. The method of the invention finds value in both automated and manual folding operations.

33 Claims, 9 Drawing Sheets

METHOD AND APPARATUS FOR FOLDING A LONG SLEEVE SHIRT

FIELD OF THE INVENTION

This invention relates generally to the field of garment preparation and packaging; and especially to the folding of garments.

BACKGROUND OF THE INVENTION

In the garment packaging industry, a great deal of value is placed on the processes involved in the folding of the garments. The proper fold and/or folding techniques can influence, without limitation, such things as: the bulk of the final package, affecting such as the number of items per box, box size and shelf space; folding speed, affecting such as production speed and production cost; and presentation, affecting customer appeal and the bottom line—sales. Long-sleeve, upper-body garments such as shirts, sweatshirts and jerseys are notorious for presenting difficulties in the areas, at least, of bulk, folding speed and presentation. This is due mostly to the awkward presence of the long sleeves which present added bulk when folded and which represent a problem for prior art automatic folding machines.

It is not uncommon in the industry to find automatic folding machines which quickly fold shortsleeve shirts with little or no human intervention beyond placing the short-sleeve shirt flat on a feed tray. However, the most common automated methods of folding long-sleeve shirts still require a human operator to hand-fold the sleeves behind the garment torso prior to placing the shirt on the folding tray. This is time consuming as well as inconsistent in sleeve placement; and furthermore, most hand-fold methods result in an unacceptably bulky accumulation of sleeve material.

SUMMARY OF THE INVENTION

Briefly described, the present invention comprises a method of folding a long-sleeve garment which includes a method of pre-folding the sleeves which pre-folding method lends itself to automated techniques; and further comprises an apparatus for performing the invented method, including the pre-folding method. The method of the invention finds value in both automated and manual folding operations.

It is, therefore, an object of the present invention to provide a method of folding a longsleeve garment.

Another object of the present invention is to provide a method of pre-folding a long-sleeve garment which method is capable of being performed by automated mechanisms.

Yet another object of the present invention is to provide a method of folding a long-sleeve garment which method results in a neatly folded garment of acceptable bulk.

Still another object of the present invention is to provide a method of folding a long-sleeve garment which provides finished, folded products with a selectable variety of folds.

Another object of the present invention is to provide an apparatus for folding a long-sleeve garment.

Another object of the present invention is to provide an apparatus for pre-folding a long-sleeve garment and for interfacing with pre-existing automated mechanisms.

Yet another object of the present invention is to provide an apparatus for folding a long-sleeve garment which provides finished, folded products with a selectable variety of bulk.

Still another object of the present invention is to provide an apparatus for folding a long-sleeve garment which provides finished, folded products with a selectable variety of folds.

Other objects, features and advantages of the present invention will become apparent upon reading and understanding this specification taken in conjunction with the attached drawings.

DETAILED DESCRIPTION OF THE PREFERRED EMBODIMENT

Figure 1:
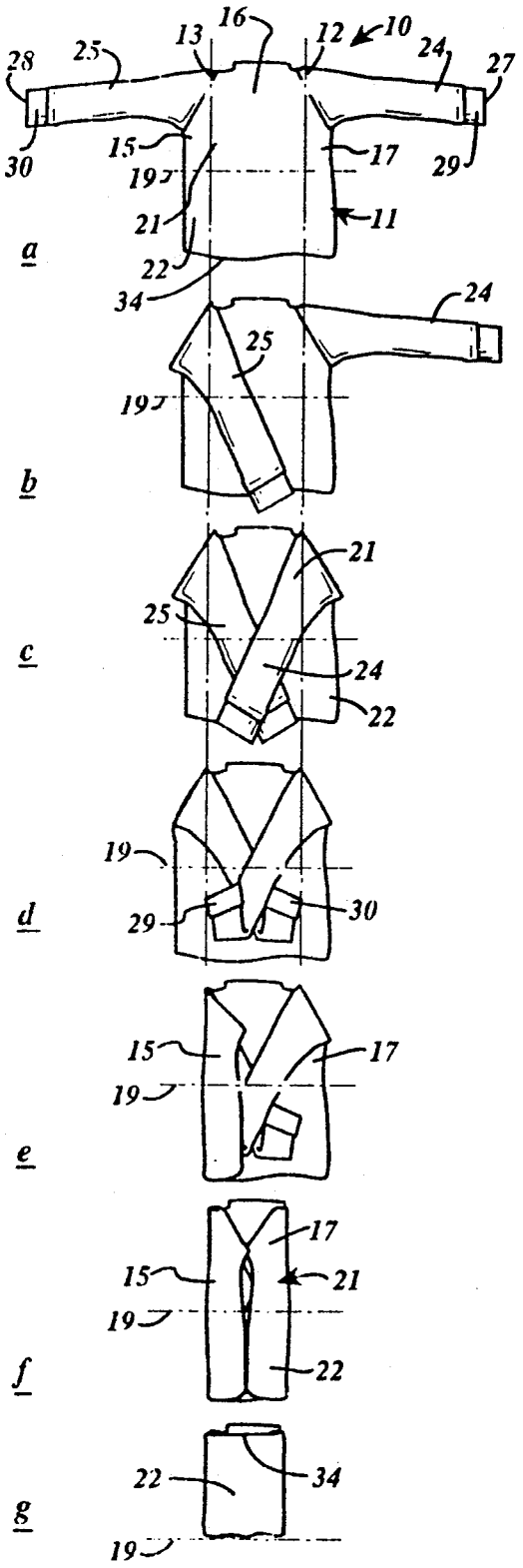
FIG. 1 is a schematic representation of a long-sleeve garment folding method in accordance with the present invention, depicting a preferred embodiment thereof.

Referring now in greater detail to the drawings in which like numerals represent like components throughout the several views, FIG. 1. represents one folding method which illustrates the method of the present invention. This drawing is used for illustrating a manual performance of the invented method. Automated performance is described later and is performed with the garment 10 in an up-side-down position relative to that depicted in FIG. 1. The garment 10, is generally any typical, long-sleeve, upper-body garment which is capable of receiving and maintaining a fold; and will be referred to throughout this specification as simply a "garment".

The garment 10 is seen generally as comprising a torso 11 and two long sleeves 24, 25 For ease of description and explanation, throughout this specification, the torso 11 will be thought of as being divided into a plurality of lateral segments and vertical portions. Imaginary lines 12, 13 divide the torso 11 into a left-side segment 15, a central segment 16 and a right-side segment 17. Imaginary line 19 divides the torso 11 into a top portion 21 and a bottom portion 22. When practicing the present invention, the width of the central segment 16 is preestablished by the user (customer) requirement for the width of the final, folded product. Once the final fold width, and thus the width of the central segment 16, is established, the width of the side segments 15, 17 are defined as, preferably, equal halves of the remainder of the garment width.

With reference to FIG. 1, the garment 10 is laid out with the sleeves 24, 25 stretched out beside or hanging down below the torso 11 (step 1*a*). Though a matter of choice based on the final, desired presentation, the garment 10 is intended in FIG. to be depicted as lying face-down. Each sleeve 24, 25 is then folded, alternately, diagonally across the torso 11. (See steps 1*b*, 1*c*). In the preferred embodiment, the sleeves 24, 25 are crossed with the free end 27, 28 of each sleeve extending beyond the other sleeve (step 1*c*). Since most garments 11 are formed with a bulky cuff section 29, 30 at the end of the sleeve 24, 25, it is preferred that the cuff section 29, 30 of each sleeve 24, 25 extend beyond the other sleeve, as depicted in FIG. 1*c*. Furthermore, in the preferred embodiment of the invented method, the free ends 27, 28 (and cuff sections 29, 30), while extending beyond the respective other sleeves 24, 25, are maintained within the central segment 16 and within the bottom portion 22 of the torso 11.

FIGS. and 2 depict alternate embodiments of the invented method for step "d". In the method embodiment of step 1*d*, the cuff sections 29, 30 are folded back as shown, preferably along a fold line parallel to the imaginary, horizontal line 19. This embodiment results in what is to be called the "hidden cuff" fold. In the method embodiment of step 2*d*, the cuff sections 29, 30 together with the lower section 32 of the torso 11 are all folded back as shown, preferably along a fold line parallel to the imaginary, horizontal line 19. This embodiment results in what is to be called the "hidden cuff and hidden waist" fold. Still an alternate embodiment of the method, not shown, skips step "d" altogether and proceeds direct to step "e".

In step "e", a first body-fold is made along imaginary, vertical line 13 to fold the left side segment 15 of the torso 11 relative to the central segment 16, with portions of the sleeves 24, 25 interposed between the side segment 15 and the central segment. In step "f", a second body-fold is made along the imaginary, vertical line 12 to fold the right side segment 17 of the torso 11 relative to the central segment 16. In the depicted embodiment, portions of the sleeves 24, 25 are interposed between the right side segment 17 and the central segment 16, and the two side segments 15, 17 abut one another or only slightly overlap. The proximity of the folded side segments 15, 17 to one another (i.e. wide gap, abutting, partially overlapping, or fully overlapping) depends upon the predetermined, final fold width discussed above. The relative amounts of portions of each sleeve 24, 25 which are interposed between the left side segment 15 and central segment 16, between the right side segment 17 and central segment 16, and/or between the right side segment 17 and the left side segment 15 is likewise dependant upon (i) the predetermined, final fold width discussed above and (ii) the amount of crossing of the two sleeves. It is understood that the order of steps "e" and "f" is reversible.

Figure 2:
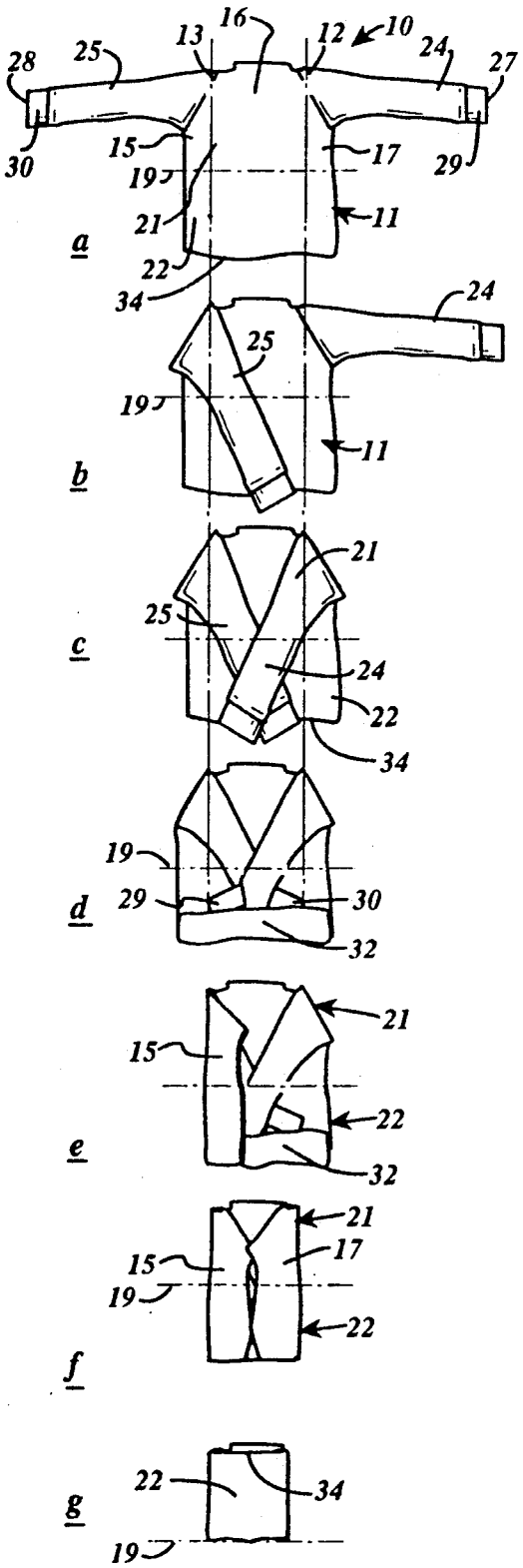
FIG. 2 is a schematic representation of a long-sleeve garment folding method in accordance with the present invention, depicting an alternate embodiment to that of FIG. 1.
Figure 3:
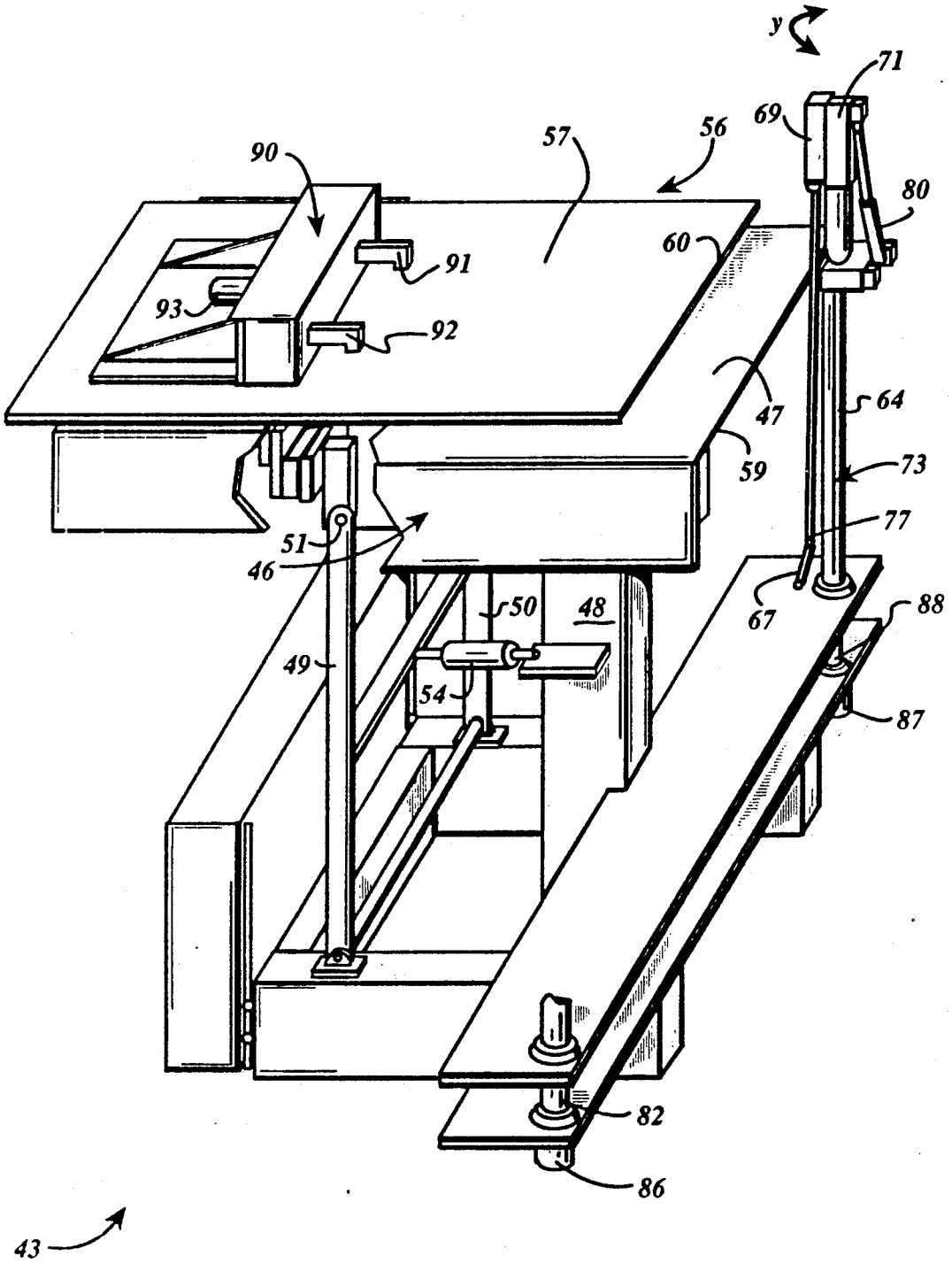
FIG. 3 is an isolated, pictorial view of a Long-sleeve Garment Folding Apparatus, in accordance with the present invention, showing a portion of the long-sleeve garment pre-folding device.

Finally, a final body-fold of the garment 10 is is made about the horizontal line 19 to fold the bottom portion 22 of the torso relative to the top portion 21. It is noted that in the method embodiment of FIG. 1, the horizontal line 19 is, preferably, slightly higher up on the torso 11 than the horizontal line 19' in the embodiment of FIG. 2.

Detailed in FIGS. 3–8 is one embodiment of invented long-sleeve garment folding apparatus 40 for performing the invented method of folding described above. The apparatus 40 is comprised of a garment-body folding device 42 and a long-sleeve pre-folding device 43. The body folding device 42 is, in the preferred embodiment, substantially similar to folding devices known in the prior art and, because of its familiarity in the industry, it is shown in the drawings only in schematic representation at FIGS. 6B, 6C, 7B, 7C and 8. One example of a body folding device 42 acceptable in accordance with the present invention is a device known in the industry as the Amscomatic K-700 Automatic Folding Machine manufactured by All-Pak Machinery Systems, Inc. of Decatur, Ga.; which K-700 machine is operated, generally, in accordance with the manufacturer's instructions. Thus, the body folding device 42 will be detailed herein as to structure and operation only to the extent deemed necessary to understand the present invention. In spite of the pre-existing nature of the body folding device, the use of the device to accomplish the folding method and the final folded product of the present invention is accomplished only with reference to the present invention and in combination with a prefolding device 43, or in combination with a manual pre-folding method performing the function of the pre-folding device.

The pre-folding device 43 constitutes an improvement to the folding devices of the prior art. The preferred embodiment of the prefolding device 43 comprises a lower platform 46 with a lower platform surface 47 supported above the ground surface by a stationary beam 48 and two rocker beams 49, 50. The lower platform 46 is fixed by a pivot hinge 51 to the rocker beams 49, 50 and rests freely on a roller 52 above the stationary beam 48. A first air cylinder 54, also referred to as the feed cylinder 54, connects the stationary beam 48 and the rocker beams 49, 50. When activated, the feed cylinder 54 selectively moves the lower platform 46 in the directions of arrows "A" or "B". (See FIG. 4.) An upper platform 56 is supported in cantilevered fashion at a fixed distance above the lower platform surface 47, and comprises an upper platform surface 57. The lower platform surface 47 defines a leading edge 59 which is a straight-edge aligned perpendicular to the directions of arrows "A" and "B". The upper platform 56 defines an outer end 60 which is set back from the leading edge 59 of the lower surface 57.

The preferred embodiment of the pre-folding device 43 further comprises two tucking bars 63, 64. (See FIGS. 4 and 5) Each tucking bar 63, 64 includes a free end (indicated as 66 and 67, respectively) and a mounted end (indicated as 68 and 69, respectively). The first tucking bar 63 is mounted at its mounting end 68 to top 70 of a first upright post 72. The second tucking bar 64 is mounted at its mounting end 69 to the top 71 of a second upright post 73. The tucking bars 63, 64 are mounted to the respective posts 72, 73 in a pivoting manner so as to pivot between a down position (preferably vertical) and an up position (preferably horizontal). (See arrows "x" of FIG. 4.) The first tucking bar 63 is moved through its pivot path "x" by an air cylinder 79, also referred to as the first up-down cylinder 79, which cylinder is also mounted to the first post 72. The second tucking bar 64 is moved through its pivot path "x" by an air cylinder 80, also referred to as the second up-down cylinder 80, which cylinder is also mounted to the second post 73. Furthermore, the first post 72, is connected at its bottom end 82 to a first rotary air cylinder 86 which, when activated moves the first post in a rotary motion (see arrows "y" of FIG. 3) about the vertical axis of the respective post. The second post 73 is connected at its bottom end 83 to a second rotary air cylinder 87 which, when activated, moves the second post in a rotary motion (see arrows "y" in FIG. 6A.) about the vertical axis of the respective post. The rotary air cylinders 86, 87 are, in the preferred embodiment, limited in their range of rotational movement to a range defined by points "$y_1$" and "$y_2$". In the preferred embodiment, this range is between approximately 80° and 90° of angular motion, which is intended to give the tucking bars 63, 64 only narrow clearance of the lower platform 46 as the bars move up and down at the respective $y_1$ and $y_2$ positions.

Preferably, the tucking bars 63, 64 are each mounted to their respective post 72, 73 with their mounting ends 68, 69 supported at a certain distance above the ground surface such that, when the bar is pivoted to the "up" (horizontal) position, the respective bar is lying within a plane that is oriented between the lower platform surface 47 and the upper platform 56. In the preferred embodiment, the two upright posts 72, 73 are positioned symmetrically displaced from the lower platform 46.

In the preferred embodiments of the present invention, the tucking bars 63, 64 are each formed with a bend (76, 77 respectively) located at a point along their length. Placement of this bend 76, 77 assists in determination of the placement of the respective sleeve 24, 25 during the automated long-sleeve prefolding step of the invented method. This is explained more later.

A clamp assembly 90 is mounted to the back end of the upper platform surface 57 and includes clamping fingers 91, 92. The clamping fingers 91, 92 are movable by action of an air cylinder 93 and a pivot linkage (not seen) between a clamping position abutting the upper platform surface 57 and a raised position above and off the surface 57.

Figure 4:
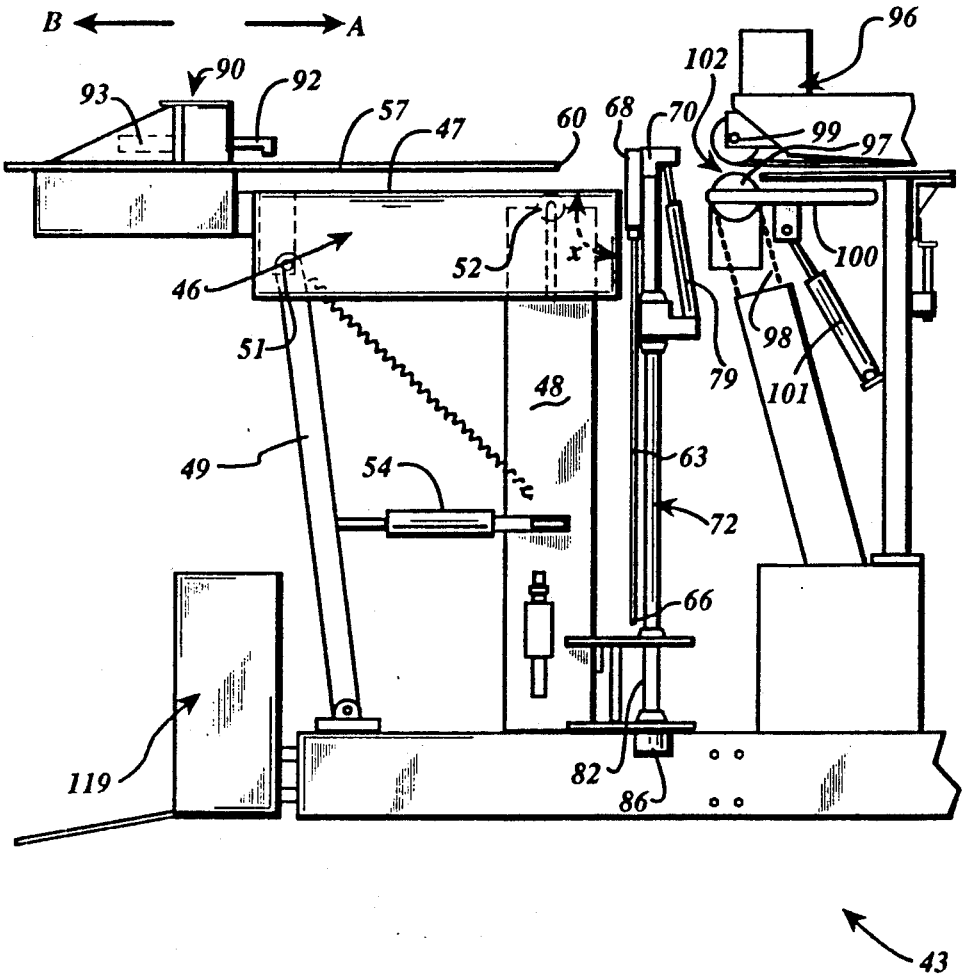
FIG. 4 is an isolated side view of the garment folding apparatus of FIG. 3, showing the pre-folding device.
Figure 5:
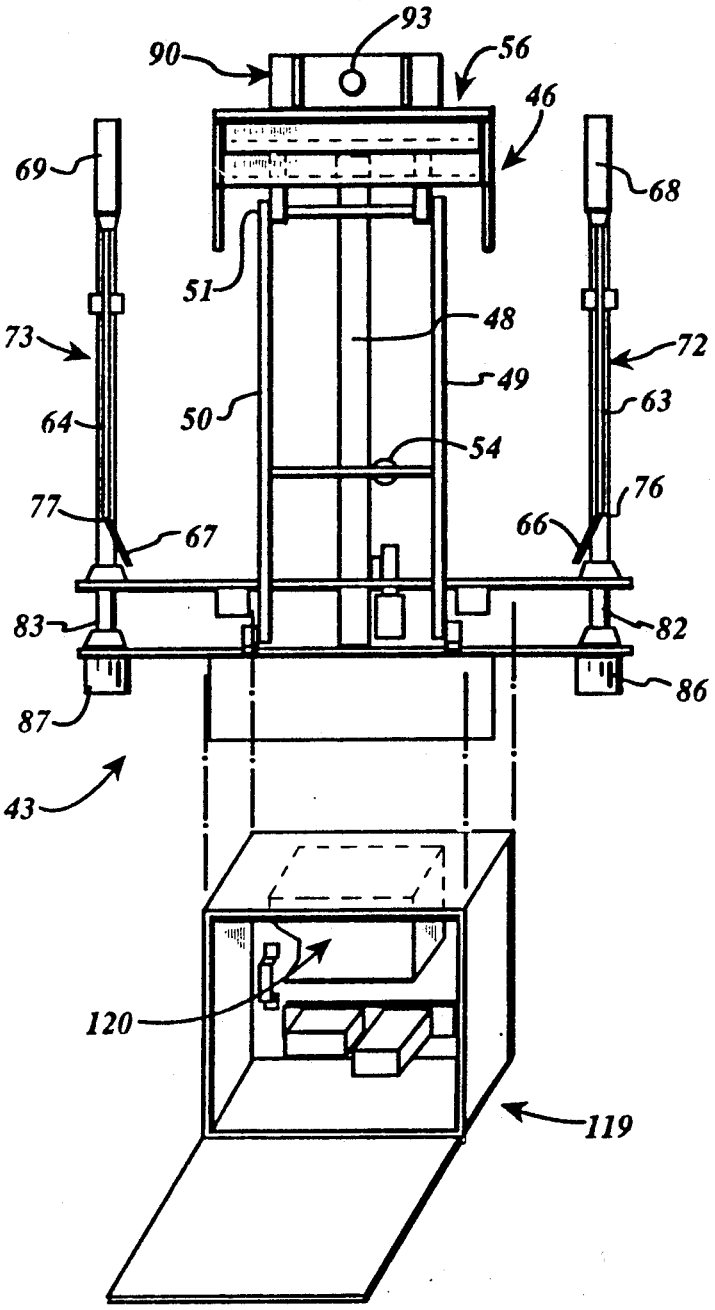
FIG. 5 is an isolated end view, viewed from the left side of FIG. 4, of the pre-folding device seen in FIG. 4, with the controller box exploded away.

With reference to FIG. 4, the pre-folding device 43 is seen as also including a pinch roll assembly 96. Although an existing component of pre-existing folding devices such as the abovementioned AllPak K-700, the pinch roll assembly 96 functions as an integral component of the prefolding device 43 of the present invention, cooperating with other components to perform an inventive step in the preferred embodiments of the invented method. The pinch roll assembly 96 includes a lower pinch roll 97 driven by a drive belt 98, and an idler roll 99 rotatable about a stationary axis. The pinch roll 96 is rotatably mounted on a pivoting frame 100. An air cylinder 101 (also called the pinch roll cylinder 101) maintains the pinch roll 97 in close proximity to the idler roll 99 to define a first "pinch point" 102 between the two rolls. A belt 105, known in the industry as the "fold belt", moves about the idler roll 99 through the pinch point 102 and extends along the body folding device 42.

The body folding device 42 is seen in representative form in FIGS. 6B, 6C and 7B, 7C and 8 as generally including the fold belt 105 driven in a continuous loop by a drive roll (not seen), a folding plate 108, down-guides 109, 111, a weight plate 110, a first tucker plate 112, a second tucker plate 114, a final fold assembly 115, including folding fingers 116, and a second pinch roll assembly 117 defining a second pinch point 118. As stated previously, the body folding device 42 is understood in the industry and a more expansive description of the device is not deemed necessary in this disclosure.

The various air cylinders, being the feed cylinder 54, the first up-down cylinder 79, the second up-down cylinder 80, the first rotary cylinder 86, the second rotary cylinder 87, and the clamp cylinder 93, mentioned above are, in the preferred embodiment, all rod-and-piston, air actuated cylinders of a type known and understood in the industry. The activation, deactivation, directional instruction and cooperative interaction of each and all of the cylinders is performed by a controller 119 incorporating simple programmed control logic, the design and operation of which is considered readily understood and practicable by one skilled in the art once the operation sequence described below is reviewed. Further description or explanation of the cylinders, controller, logic and connection thereof in this specification is deemed inappropriate and unnecessary. The invention is not to be limited by the use of pneumatics nor by the use of any particular control logic.

OPERATION. The following is a description of the particular embodiment of the invented method as performed by the herein described embodiment of the Long-sleeve Garment Folding Apparatus 40 in accordance with the present invention. The operation is discussed with reference to the schematic flow drawing of FIG. 6A, 6B, 6C, and 7A, 7B, 7C, as well as to FIGS. 4, 5 and 8.

Figure 9:
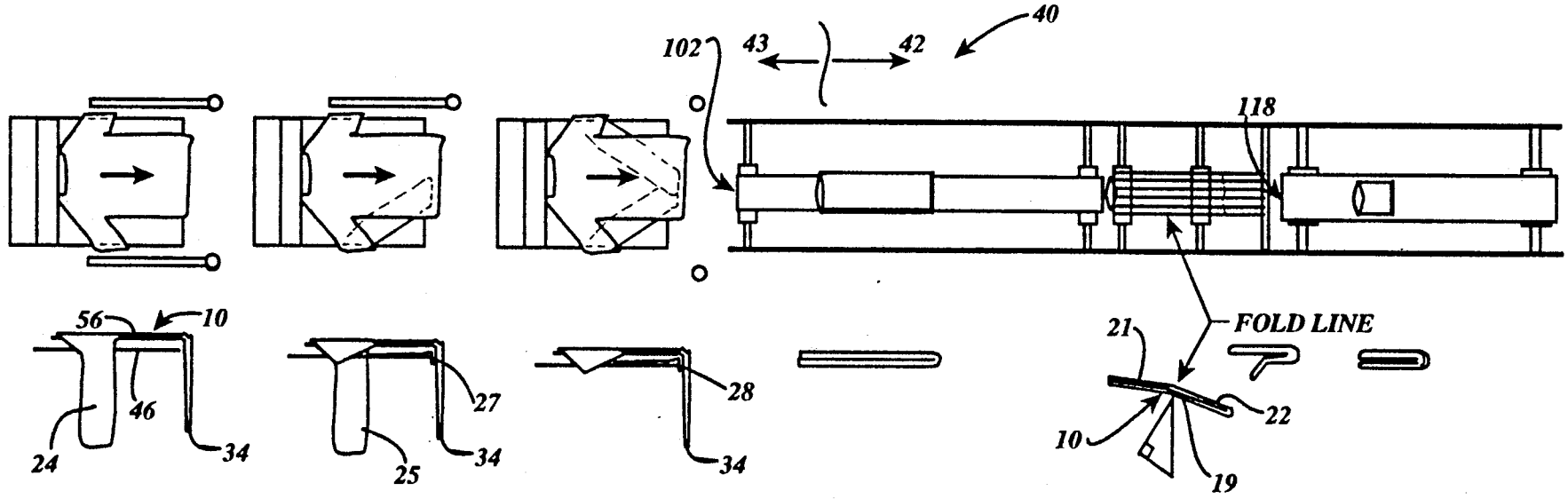
FIG. 9 is a schematic representation of FIGS. 6A,C and 7A,C depicting an embodiment of the method of the present invention alternate to that depicted in FIGS. 6A,C and 7A,C.
Figure 8:
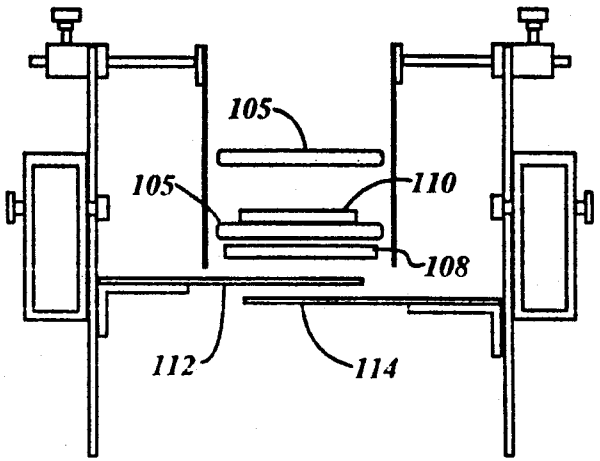
FIG. 8 is a view taken along lines 8—8 of FIG. 6B, depicting, in schematic representation, a view of the body folding device.

The user places a long sleeve garment on the upper platform surface 57, usually face-up, with the sleeves 24, 25 hanging down below the lower platform surface 47. The garment 10 is oriented with the torso top portion 21 adjacent the clamp assembly 90. The torso bottom portion 22 is positioned to hang over the outer end 60 of the upper platform 56 and onto the lower platform surface 47. In embodiments of the method where there is a long tail on the garment or a waist which is to be "hidden", the tail/waist also drapes down over the leading edge 59 of the lower platform surface 47. (See FIG. 9.) In embodiments where there is to be no hidden waist or tail, the bottom edge 34 of the garment 10 is placed to extend only slightly beyond the leading edge 59 of the lower platform. (See FIG. 6A.) In order to accommodate the choice of final fold parameters which call for (i) a "hidden" waist or tail and (ii) the amount of hidden portion, or (iii) no hidden bottom edge 34, clamp assembly 90 is movable along the upper platform surface 57 in the directions of arrows "A" and "B" of FIG. 4. After moving, the clamp assembly 90 is fixed in place.

With the garment 10 appropriately placed on the upper platform surface 57, the apparatus 40 is "turned on" to begin the sequence of steps programmed in the programmed control logic 120 of the pre-folding device 43 and to activate the pinch roll drive belt 98 and fold belt 105, as well as the other operations of the body folding device 42. The Long-sleeve Garment Folding Apparatus 40 of the disclosed embodiment then performs the following operations (reference to "steps" refer to FIGS. 6A–C and 7A–7C):

1. The clamping fingers 91, 92 (which were previously in a raised position) are lowered, by action of the clamping cylinder 93, to clamp the garment 10 at its top portion 21 to the upper platform surface 57.

2. Both rotary cylinders 85, 86 and both up-down cylinders 79, 80 are reset to their "start" positions. (See step a.) The start position for the up-down cylinders 79, 80 is with the tucking bars 63, 64 in the down (vertical) position. The cylinders 79, 80 are equipped with sensors (not seen) to sense the down position. The start position for the rotary cylinders 85, 86 is, preferably, at their respective $y_1$ position. Each cylinder 85, 86 is equipped with sensors to sense the start position.

3. Both tucking bars 63, 64 are then raised to their up (horizontal positions) by the respective up-down cylinders 79, 80. (See step b.)

4. The first tucking bar 63 is moved by its rotary cylinder 85 in the "in" or tuck direction; in this case, clockwise as viewed in FIG. 6. (See step c.) As it moves in, the first bar 63 engages the hanging, right sleeve 24 and sweeps it between the two platforms 46, 56. As the bar 63 sweeps the sleeve 24, the sleeve slides along the bar toward the free end 66 until the sleeve encounters the bend 76. The bend carries the sleeve 24 until the bar 63 clears the leading edge 59 of the lower platform surface 47. (See step d.) At this point, a sensor (not seen) in the first rotary cylinder 86 senses that the cylinder (and thus the bar 63) bar has reached its respective $y_2$ position, which is the allowed limit of its rotation; and the controller 119 instructs the first up-down cylinder 79 to drop the bar 63 to the down position. When the bar 63 drops, the sleeve 24 is left resting on the lower platform surface 47. In the preferred embodiment, the bend 76 is located along the tucking bar 63 at a distance from the mounted end 68 sufficiently far to reach beyond the sleeve for initial engagement and at a distance from the mounted end such that as the bend carries the sleeve, it will orient the sleeve, when viewed from a planar view, diagonally across the garment torso 11, with the free end 27 of the sleeve within the lateral boundaries (i.e. between imaginary lines 12, 13) of the torso central segment 16.

5. If it is intended to fold the second sleeve 25 (some alternate embodiments fold only one sleeve), then once the first tucking bar 63 has completed approximately seventy-five percent of its rotation, the second tucking bar 64 is moved by its rotary cylinder 87 in the "in" or tuck direction; in this case, counter-clockwise as viewed from the top. As it moves in, the second bar 64 engages the hanging, right sleeve 25 and sweeps it between the two platforms 46, 56. (See step d.) As the bar 64 sweeps the sleeve 25, the sleeve slides along the bar toward the free end 67 until the sleeve encounters the bend 77. The bend carries the sleeve until the bar 64 clears the leading edge 59 of the lower platform surface 47. (See step e.) At this point, a sensor (not seen) in the second rotary cylinder 87 senses that the cylinder (and thus the bar 64) has reached its respective $y_2$ position, which is the allowed limit of its rotation; and the controller 119 instructs the second up-down cylinder 80 to drop the bar 64 to the down position. When the bar 64 drops, the sleeve 24 is left resting on the lower platform surface 47 beneath the left sleeve 23. In the preferred embodiment, the bend 77 is located along the tucking bar 64 at a distance from the mounted end 68 sufficiently far to reach beyond the sleeve for initial engagement and at a distance from the mounted end such that as the bend carries the sleeve, it will orient the sleeve, when viewed from a planar view, diagonally across the garment torso 11, with the free end 27 of the sleeve within the lateral boundaries (i.e. between imaginary lines 12, 13) of the torso central segment 16. Preferably, though not necessarily, the free ends 27, 28 of each sleeve 24, 25 extends at least slightly beyond the other sleeve.

Note: The sleeves 24, 25 are preferably positioned by the tucking bars 63, 64 such that the free ends 27, 28 hang at least partially over the leading edge 59 of the lower platform surface 47.

Figure 6A:
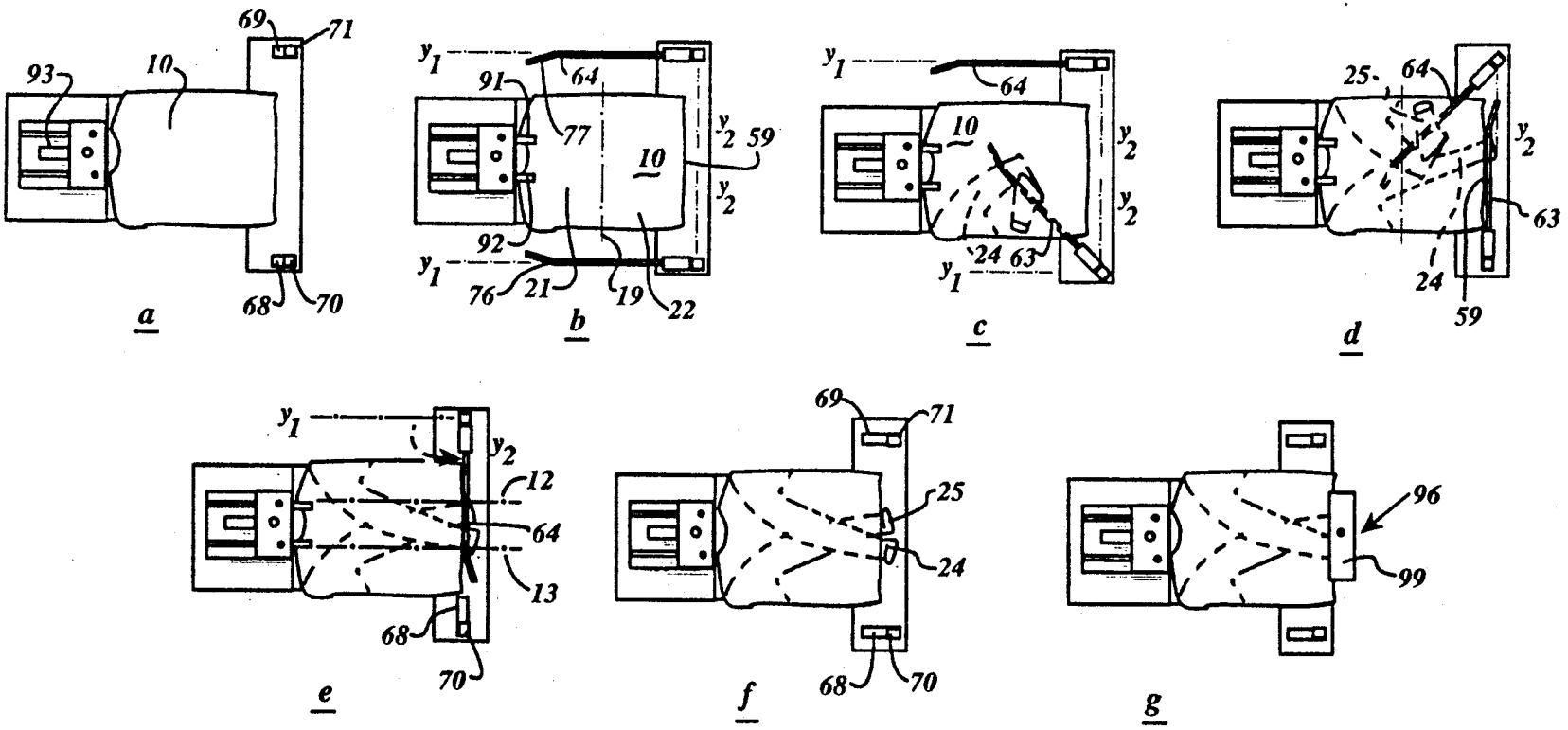
FIG. 6A is a schematic representation of the pre-folding device of FIG. 4 and of the pre-folding method performed by the pre-folding device portion of the Long-sleeve Garment Folding Apparatus in accordance with the present invention, all showing the top view.
Figure 7A:
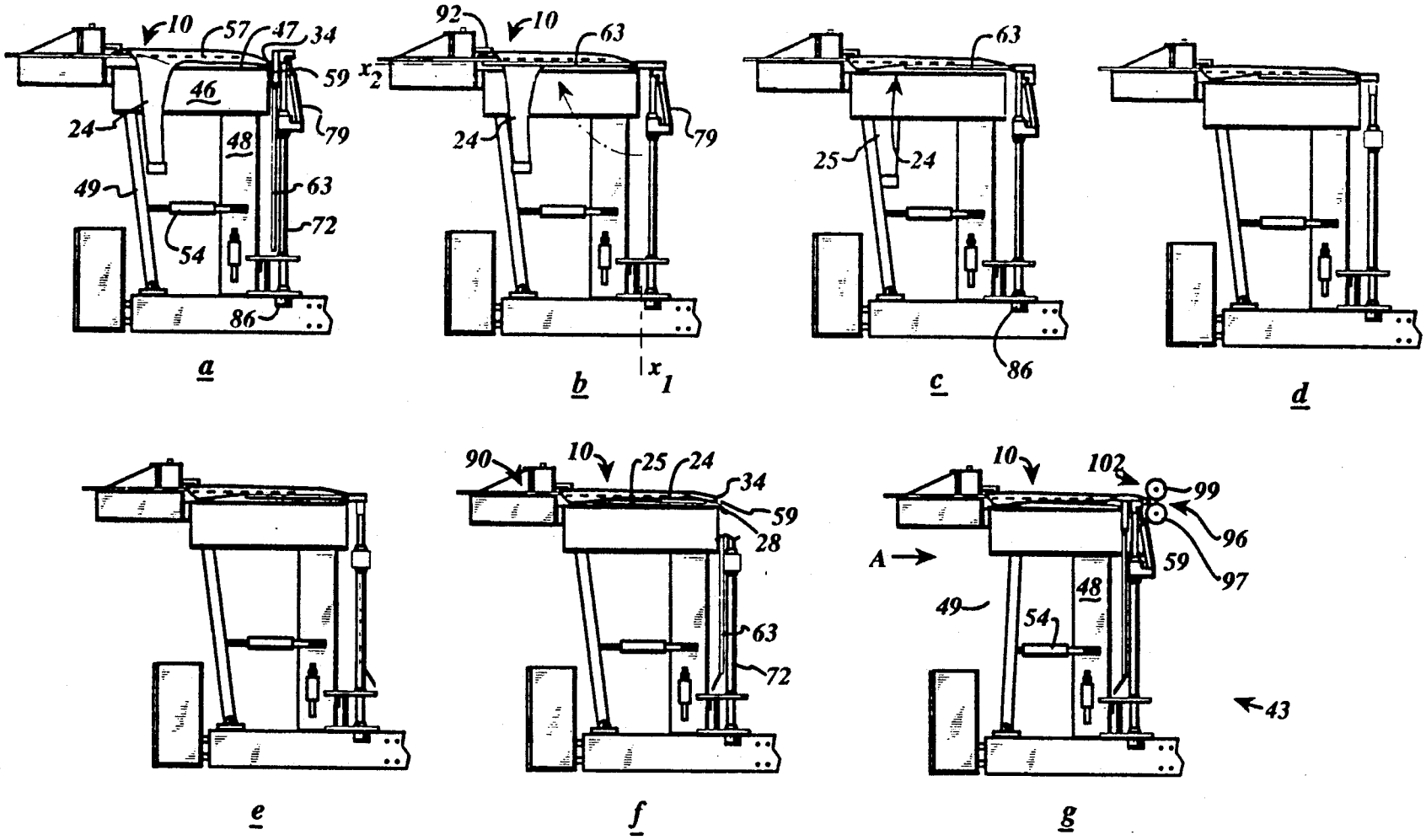
FIG. 7A is a side view of the schematic representations of FIG. 6A.
Figure 6B:
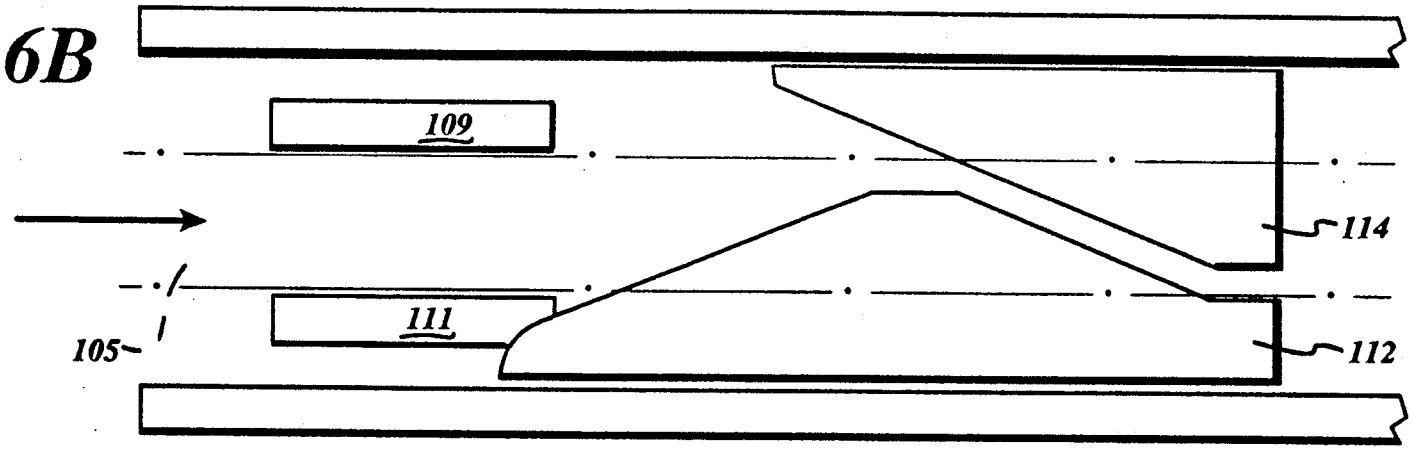
FIGS. 6B and 6C are consecutive, schematic representations of the body folding device portion of the Long-sleeve Garment Folding Apparatus in accordance with the present invention, and of the portions of the garment folding method performed by the body folding device, all shown in top view.
Figure 7B:
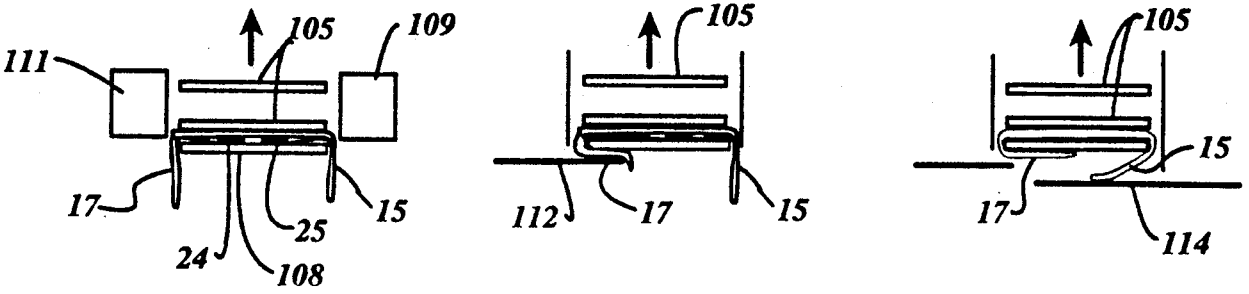
FIG. 7B is a compilation of schematic endviews taken at various locations along the schematic representation of FIG. 6B, such endviews viewed from the downstream side.
Figure 6C:
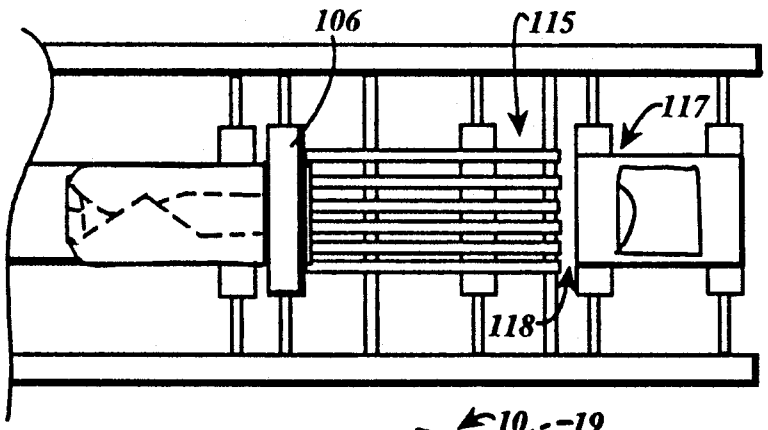
Figure 7C:
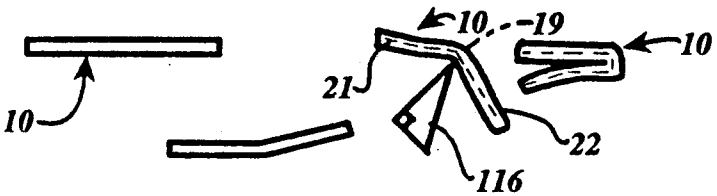
FIG. 7C is a compilation of schematic side views viewed at various locations along the schematic representation of FIG. 6C.

6. When both tucking bars 63, 64 are sensed in the down position after completion of their tucking sweep, the feed cylinder 54 moves the lower platform 46, together with the upper platform 56, in the direction of arrow "A" until the leading edge 59 of the lower platform surface 47 is brought adjacent the first pinch point 102. (See step g.) When the leading edge 59 reaches the pinch point 102, the pinch roll assembly 96 grasps the garment 10 at the section of material which is introduced to the pinch point 102 by the leading edge 59. Any portion of the garment 10 which is hanging more than a slight distance below the lower platform surface 47 is folded under in a first fold, such as the hidden waist or hidden tail or hidden cuff folds. If the torso bottom edge 34 or the sleeve free ends 27, 28 are adjacent the lower platform leading edge 59, but not more than slightly overhanging, the pinch roll assembly 96 grasps that edge and/or sleeve, but does not fold it. The embodiment of FIGS. 6A–6C depicts the hidden cuff fold where the free ends 27, 28 of the sleeves are pre-folded back but the bottom edge 34 not pre-folded. Such a fold might find application on, for example, a straight waisted sports jersey. In such a hidden cuff embodiment, the tucking bars 63, 64 sweep the sleeve free ends 27, 28 to a distance substantially overhanging the lower platform leading edge 59, in order that they will be folded at the first pinch point 102. Yet the torso bottom edge 34 must only slightly overhang so as not to be folded. In one such embodiment, a relatively narrow upper platform 56 is used (narrow relative to the overall width of the garment torso 11) whereby the tucking bars 63, 64 tuck under a portion of the garment shoulder with each sleeve to add to the effective length of the sleeves 24, 25 relative to the torso 11, thus allowing the sleeves ends 27, 28 to extend beyond the torso bottom edge 34 and overhang the platform edge 59.

7. The garment 10 is gripped between the fold belt 105 and the folding plate 108, is pulled off the upper platform 56 by the action of the moving fold belt 105, and is moved in the direction of arrow "A" along the folding plate. (See FIGS. 6B, 7B.) Downguides 109, 111 on either side of the folding plate 108 force the side segments 15, 16 of the garment 10 to hang down below the folding plate 108. (See step h.) The right side segment 15 engages the first tucker plate 112 which folds (tucks) the right side segment 15 up and underneath the central segment 16 (with the folding plate still between the segments) and at least portions of the two sleeves 24,

25 are interposed between the right side segment 15 and the central segment 16. (See step i.) The left side segment 17 then engages the second tucker plate 114 which folds the left side segment up and underneath the central segment 16 (with the folding plate 108 still between the segments). (See step j.) The amount of overlap, if any, between the two side segments 15, 17 is dependant upon the width of the folding plate 108.

8. As the garment 10 continues to be moved along by the fold belt 105, the garment moves off the folding plate 108 and is engaged by the folding fingers 116 of the final folding assembly 115 which introduce a final fold in the garment (i.e. along the imaginary line 19) by pushing an intermediate section of the garment into the second pinch point 118. (See FIGS. 6C, 7C.)

Whereas, the Long-sleeve Garment Folding Apparatus 40 of the present invention is preferably operated to perform the preferred method embodiment, the invented apparatus also performs alternate embodiments of the method which result in varying final folds and variety of bulk. Without limiting the scope of the alternate embodiments, it is noted that by predetermining certain parameters for the final, folded product, certain variations to the automated embodiments of the invented folding method and/or to the apparatus are warranted in accordance with the present invention. Some such predetermined parameters include:

(i) Final fold width, thus choosing the width of the central segment 16 of the torso 11. The choice of final fold width determines the selection of the folding plate 108 of the body folding device 43. The width of the folding plate 108 is chosen to match the final fold width. Furthermore, in accordance with the present invention, the sleeves 24, 25 are to be pre-folded such that their free ends 27, 28 are located within the lateral boundaries of the central segment 16 of the torso 11. Thus, the choice of the final fold width (and thus the central segment 16 width) affects the selection of the tucking bars 63, 64. The tucking bars 63, 64 are, in accordance with the present invention, chosen for relative placement of the bend 61, 62 along the bar length In certain alternate embodiments, the bars 63, 64 have no bends.

(ii) Presentation, such as "hidden cuff" and "hidden waist and cuff", affecting, among other things, positioning of the clamp assembly 90, placement of the garment 10 on the upper platform surface 57 and upper platform width.

(iii) Presentation, such as whether one sleeve is to be folded into the torso and the other left out for display, or whether both sleeve will be folded into the torso. In one alternate embodiment whereby only one sleeve is to be folded, the controller 119 is temporarily programmed to operate only one tucking bar. The user places the un-tucked arm, for example, folded over the top (face) of the garment.

(iv) Predetermination of other final fold parameters and their impact on various steps of the method and apparatus setup and operation will become apparent upon reading and under standing this specification.

Whereas, the preferred methods of the present invention provide for overlapping and/or crossing of the sleeves 24, 25 during pre-folding, it is understood that the apparatus of the present invention is not limited to such a sleeve placement and, in some embodiments, the apparatus 40 arranges the sleeves side-by-side. Furthermore, the apparatus 40 is used to pre-fold various sleeve lengths, such as threequarter length sleeves. The apparatus 40 of the present invention, although it is an apparatus for performing the invented methods, is not limited in scope to performance solely of the invented methods.

Whereas the invented methods and apparatus have been described in detail with particular reference to preferred embodiment thereof, it will be understood that variations and modifications can be effected within the spirit and scope of the invention, as described hereinbefore and as defined in the appended claims.

What is claimed is:

1. Method of pre-folding the long sleeves of a long-sleeve garment for eventual further folding and packaging, which further folding includes at least folding of the garment to be of a predetermined, final fold width, said method of pre-folding comprising the steps of:

supporting a first platform raised above a ground surface;

supporting a second platform vertically displaced above the first platform;

supporting a long sleeve garment on the second platform, at least one of the sleeves of the garment hanging down below the first platform;

tucking the hanging-down sleeve between the first platform and the second platform; and sliding the garment off the platforms while retaining the sleeve tucked beneath the garment torso.

2. Method of claim 1, wherein the step of supporting the long sleeve garment includes the step of supporting a long sleeve garment on the second platform with both sleeves of the garment hanging down below the first platform on opposite sides of the platforms; and wherein the tucking step includes the step of tucking both of the hanging-down sleeves between the first platform and the second platform.

3. Method of claim 2, wherein the tucking step comprises the step of alternately tucking one sleeve between the first platform and the second platform and then tucking the other sleeve between the first platform and the second platform.

4. Method of claim 1, wherein the tucking step further comprises the steps of: orienting the tucked sleeve, in planar view, diagonally across the garment torso; and aligning the sleeve free end within the lateral boundaries of a central segment of the torso corresponding in width to the predetermined final fold width.

5. Method of claim 1, wherein during the step of supporting the garment, the bottom portion of the garment overhangs the first platform in an amount sufficient to be grasped by mechanical means.

6. Method of claim 1, wherein, during the step of supporting the garment, the second platform engages a portion of the garment torso of predefined width, thereby predefining the amount of sleeve and shoulder which will be tucked between the first and second platforms.

7. Method of claim 1, further comprising the step of gripping the top portion of the garment before the tucking step.

8. Method of claim 1, wherein the tucking step comprises, at least, the step of moving a bar member from beyond the platforms through the space between the first platform and the second platform to catch the hanging down sleeve with the bar member and to sweep the sleeve under the second platform and between the first and second platforms.

9. Method of claim 8, wherein the tucking step further comprises the steps of: orienting the tucked sleeve, in planar view, diagonally across the garment torso; and aligning the sleeve free end within the lateral boundaries of a central segment of the torso corresponding in width to the predetermined final fold width.

10. Method of claim 2, wherein the tucking step comprises, at least, the steps of moving a first bar member from beyond the platforms through the space between the first platform and the second platform to catch one of the hanging-down sleeves with the first bar member and to sweep the one sleeve under the second platform and between the first and second platforms, and moving a second bar member from beyond the platforms through the space between the first platform and the second platform to catch the other hanging-down sleeve with the second bar member and to sweep the other sleeve under the second platform and between the first and second platforms.

11. Method of claim 10, wherein the tucking step further comprises the steps of: orienting the tucked sleeves, in planar view, diagonally across the garment torso; and aligning the sleeve free ends within the lateral boundaries of a central segment of the torso corresponding in width to the predetermined final fold width.

12. Method of folding a long-sleeve garment having a torso and two long sleeves, the torso being defined by a central segment and two side segments, the central segment being defined by imaginary lateral boundaries defined as two, imaginary, parallel planes spaced apart a distance corresponding to a predetermined, final fold width for the garment, the torso being further defined by a top portion and a bottom portion spanning all of the central and side portions, and the sleeves including a shoulder end connected to the top portion of the side segments and a free end opposite the shoulder end, said method comprising the steps of:

laying out a long-sleeve garment with at least a portion of the garment torso in a flat condition;

folding diagonally across the garment torso, aligning the free end of the sleeves within the lateral boundaries of the torso central segment;

folding the garment along two fold lines, each fold line lying within one of the lateral boundary planes, wherein each side segment is folded relative to the central segment, and wherein the folded sleeves are interposed between the central segment and at least one of the two side segments;

folding the garment again by bringing the bottom portion and top portion of the torso into overlying relationship.

13. Method of folding a long-sleeve garment having a torso and two long sleeves, the torso being defined by a central segment and two side segments, the torso being further defined by a top portion and a bottom portion spanning all of the central and side portions and by a waist edge, and the sleeves including a shoulder end connected to the top portion of the side segments and a free end opposite the shoulder end, said method comprising the steps of:

supporting a first platform raised above a ground surface;

supporting a second platform vertically displaced above the first platform;

supporting a long sleeve garment on the second platform, at least one of the sleeves of the garment hanging down below the first platform;

tucking the hanging-down sleeve between the first platform and the second platform; and moving the garment off the platforms and along a defined path while retaining the sleeve tucked beneath the garment torso, the defined path being perpendicular to the waist edge of the garment;

folding one side segment of the torso relative to the central segment of the torso along a first fold line parallel to the defined path of movement to orient the one side segment in position underlying the central segment, wherein at least a portion of the folded sleeve is interposed between the one side segment and the central segment;

folding the other side segment of the torso relative to the central segment of the torso along a second fold line parallel to the defined path of movement and displaced from the first fold line to orient the other side segment in position underlying the central segment, wherein the any portions of the folded sleeve not interposed between the one side segment and the central segment is interposed between the other side segment and at least one of the one side segment and the central segment.

14. Method of claim 13, wherein the step of supporting the long sleeve garment includes the step of supporting a long sleeve garment on the second platform with both sleeves of the garment hanging down below the first platform on opposite sides of the platforms; and wherein the tucking step includes the step of tucking both of the hanging-down sleeves between the first platform and the second platform.

15. Method of claim 14, wherein the tucking step comprises the step of alternately tucking one sleeve between the first platform and the second platform and then tucking the other sleeve between the first platform and the second platform.

16. Method of claim 13, wherein the tucking step further comprises the steps of: orienting the tucked sleeve, in planar view, diagonally across the garment torso; and aligning the sleeve free end within the lateral boundaries of a central segment of the torso corresponding in width to the predetermined final fold width.

17. Method of claim 13, wherein, during the step of supporting the garment, the bottom portion of the garment overhangs the first platform in an amount sufficient to be grasped by mechanical means.

18. Method of claim 13, wherein, during the step of supporting the garment, the bottom portion of the garment overhangs the first platform in an amount sufficient to be grasped and folded under by mechanical means.

19. Method of claim 13, wherein, during the step of supporting the garment, the second platform engages a portion of the garment torso of predefined width, thereby predefining the amount of sleeve and shoulder which will be tucked between the first and second platforms.

20. Method of claim 13, further comprising the step of gripping the top portion of the garment before the tucking step.

21. Method of claim 13, wherein the tucking step comprises, at least, the step of moving a bar member from beyond the platforms through the space between the first platform and the second platform to catch the hanging down sleeve with the bar member and to sweep the sleeve under the second platform and between the first and second platforms.

22. Method of claim 21, wherein the tucking step further comprises the steps of: orienting the tucked sleeve, in planar view, diagonally across the garment torso; and aligning the sleeve free end within the lateral boundaries of a central segment of the torso corresponding in width to the predetermined final fold width.

23. Method of claim 14, wherein the tucking step comprises, at least, the steps of moving a first bar member from beyond the platforms through the space between the first platform and the second platform to catch one of the hanging-down sleeves with the first bar member and to sweep the one sleeve under the second platform and between the first and second platforms, and moving a second bar member from beyond the platforms through the space between the first platform and the second platform to catch the other hanging-down sleeve with the second bar member and to sweep the other sleeve under the second platform and between the first and second platforms.

24. Method of claim 23, wherein the tucking step further comprises the step of orienting the tucked sleeve disposed, in planar view, diagonally across the garment torso.

25. Apparatus for pre-folding the long sleeves of a long-sleeve garment for eventual further folding and packaging, said apparatus comprising:

a first platform raised above a ground surface;

a second platform for supporting a long sleeve garment thereon with at least one of the sleeves of the garment hanging down below said first platform, said second platform being vertically displaced above said first platform defining a space between said first and second platforms;

means for tucking a hanging-down sleeve between said first platform and said second platform; and means for sliding a garment off said platforms while retaining the sleeve tucked beneath the garment torso.

26. Apparatus of claim 25, wherein said tucking means includes means for tucking two hanging-down sleeves between said first platform and said second platform.

27. Apparatus of claim 26, wherein said tucking means comprises means for alternately tucking one sleeve between said first platform and said second platform and then tucking the other sleeve between said first platform and said second platform.

28. Apparatus of claim 25, wherein said second platform is so constructed to engage a portion of a garment torso of predefined width, thereby predefining the amount of sleeve and shoulder which is capable of being tucked between said first and second platforms.

29. Apparatus of claim 25, further comprising means for releasably gripping the top portion of the garment while supported on said platform.

30. Apparatus of claim 24, wherein said tucking means comprises, at least, a movable bar member movable in an angular path from a first position beyond said platforms through said space between said first platform and said second platform, and means for moving said bar member through said angular path.

31. Apparatus of claim 26, wherein said tucking means comprises, at least:

a movable first bar member movable in a first angular path from a first position beyond said platforms through said space between said first platform and said second platform;

means for moving said first bar member through said first angular path;

a movable second bar member movable in a second angular path from a second position beyond said platforms through said space between said first platform and said second platform; and means for moving said second bar member through said second angular path;

wherein said first position and said second position are symmetrically displaced on opposite sides of said first and second platforms and wherein the direction of movement of said first bar member through said first angular path is opposite to the direction of movement of said second bar member through said second angular path.

32. Apparatus of claim 30, wherein said bar member comprises, at least, a bend formed therein for resisting migration of a sleeve off the end of the bar member as the bar member moves through its angular path.

33. Apparatus of claim 31, wherein each said bar member comprises, at least, a bend formed therein for resisting migration of a sleeve off the end of the bar member as the bar member moves through its angular path.

* * * * *